US006457863B1

(12) United States Patent
Vassallo

(10) Patent No.: US 6,457,863 B1
(45) Date of Patent: Oct. 1, 2002

(54) FLEXIBLE SELF-CLOSING CONTAINER

(76) Inventor: Angelo Vassallo, P.O. Box 1267, Valley Stream, NY (US) 11582-1267

( * ) Notice: Subject to any disclaimer, the term of this patent is extended or adjusted under 35 U.S.C. 154(b) by 6 days.

(21) Appl. No.: 09/583,641

(22) Filed: May 30, 2000

(51) Int. Cl.[7] ..... B65D 33/24

(52) U.S. Cl. ..... 383/43; 150/129; 150/900; 383/9; 383/35; 383/66; 383/106; 383/109

(58) Field of Search ..... 383/9, 43, 106, 383/109, 903, 35, 66, 105, 46, 51, 63; 150/900, 127, 129, 147; 206/308.1, 312, 363, 364, 303, 37, 778, 484, 484.1, 439, 306, 349; 229/74

(56) References Cited

U.S. PATENT DOCUMENTS

| | | | | | |
|---|---|---|---|---|---|
| 286,650 | A | * | 10/1883 | Talcott | |
| 729,429 | A | * | 5/1903 | Shattuc | |
| 1,683,996 | A | * | 9/1928 | Snow | |
| 1,684,737 | A | * | 9/1928 | L'Enfant | |
| 1,741,071 | A | * | 12/1929 | Peirce | 383/35 X |
| 1,834,419 | A | * | 12/1931 | Pratt | 383/109 X |
| 2,069,549 | A | * | 2/1937 | Hutt et al. | 383/105 |
| 2,220,927 | A | * | 11/1940 | Zalkind | |
| 2,308,527 | A | * | 1/1943 | Look | 383/66 |
| 2,344,369 | A | * | 3/1944 | Salfisberg | 383/109 |
| 2,878,849 | A | * | 3/1959 | Lingenfelter et al. | 383/9 |
| 2,884,183 | A | * | 4/1959 | Frankel | |
| 2,921,731 | A | * | 1/1960 | Volckening et al. | 383/66 X |
| 3,047,139 | A | * | 7/1962 | Jacoff | 206/372 |
| 3,208,660 | A | * | 9/1965 | Brieske | 383/9 |
| 3,254,828 | A | | 6/1966 | Lerner | |
| 3,339,826 | A | * | 9/1967 | Beskind | 229/74 X |
| 3,368,600 | A | * | 2/1968 | Coniker | |
| 3,372,858 | A | * | 3/1968 | Brody | 229/74 |
| 3,507,444 | A | * | 4/1970 | Werby | 229/74 |
| 3,525,470 | A | * | 8/1970 | Carrigan | 229/74 |
| 3,826,026 | A | | 7/1974 | Bevan | |
| 3,970,130 | A | * | 7/1976 | Casey | 383/903 X |
| 3,979,051 | A | * | 9/1976 | Close | |
| 4,099,666 | A | * | 7/1978 | Welles | 383/105 |
| 4,201,299 | A | * | 5/1980 | Bumgarner et al. | 229/74 X |
| 4,286,641 | A | * | 9/1981 | Watson | |
| 4,406,371 | A | | 9/1983 | Membrino | |
| 4,417,658 | A | | 11/1983 | Gardner et al. | |
| 4,419,837 | A | | 12/1983 | Meeker | |
| 4,549,658 | A | * | 10/1985 | Sfikas | |
| 4,557,384 | A | | 12/1985 | Membrino | |
| 5,036,643 | A | * | 8/1991 | Bodolay | 383/63 |
| 5,080,223 | A | * | 1/1992 | Mitsuyama | 150/147 X |
| 5,257,656 | A | * | 11/1993 | McLeroy | 150/147 X |
| 5,263,523 | A | * | 11/1993 | Scheunemann | 150/147 X |
| 5,396,987 | A | * | 3/1995 | Temple et al. | |
| 5,407,067 | A | * | 4/1995 | Cotter et al. | |
| 5,601,368 | A | * | 2/1997 | Bodolay et al. | 383/5 |
| 5,647,480 | A | * | 7/1997 | Insley et al. | 383/66 X |
| 5,653,276 | A | * | 8/1997 | Niernberger | 150/147 X |
| 5,655,657 | A | * | 8/1997 | Roshdy | |
| 5,690,220 | A | * | 11/1997 | Swan | |
| 5,765,341 | A | | 6/1998 | Insley et al. | |
| 5,938,013 | A | | 8/1999 | Palumbo et al. | |
| 6,126,317 | A | * | 10/2000 | Anderson et al. | 383/66 X |
| 6,190,043 | B1 | * | 2/2001 | Diplock | 383/5 |

FOREIGN PATENT DOCUMENTS

| | | | | |
|---|---|---|---|---|
| CA | 549840 | * | 12/1957 | 383/66 |
| FR | 1083351 | * | 1/1955 | 206/306 |
| FR | 2643480 | * | 8/1990 | |
| FR | 2681581 | * | 3/1993 | 383/5 |
| GB | 2177677 | * | 1/1987 | 383/66 |
| WO | WO 90/02088 | * | 3/1990 | 383/9 |

* cited by examiner

*Primary Examiner*—Robin A. Hylton
(74) *Attorney, Agent, or Firm*—Fitzpatrick, Cella, Harper & Scinto

(57) ABSTRACT

A flexible bag-like container comprises front and rear flat, rectangular, equal size panels of flexible sheet material which are sealed to each other entirely around their outer periphery. The front panel is made stiff and resiliently bendable about an axis in a region near one end and the rear panel has a slit extending along a line transverse to the bending axis. The slit terminates short of the sides of said container.

14 Claims, 1 Drawing Sheet

FLEXIBLE SELF-CLOSING CONTAINER

BACKGROUND OF THE INVENTION

1. Field of the Invention

This invention relates to bag type containers which are used to package various articles of merchandise, for example, saw blades, knives, rulers, etc.

2. Description of the Related Art

Flexible, generally flat, bag type containers are shown and described in several U.S. patents, including for example, U.S. Pat. Nos. 3,254,828; 3,826,026; 4,406,371; 4,417,658; 4,557,384; 5,765,341 and 5,938,013. In general, these containers are formed from flexible plastic sheets which are sealed together around their periphery and formed with an opening in the form of a slit which extends across one of the sheets. In order to maintain the opening closed, a tab or flap is provided to cover the slit. Another patent, U.S. Pat. No. 4,419,837, shows flat sheets with non-covered slits; but those sheets are used to form holders for envelopes and the like which are carried between the sheets in such a way that they protrude out through the slits so that the slits are always open.

Another bag type construction, which is currently in use, comprises a pair of elongated rectangular plastic sheets which are sealed to each other along their side edges and along a bottom end. One of the sheets is longer than the other so that the other or top end of the shorter sheet is not sealed. A third sheet is sealed to the top and side edges of the longer sheet which extend downward beyond the top end of the shorter sheet. This third sheet includes a flap which extends down over a portion of the shorter sheet to cover the opening at the top end of the shorter sheet. A resiliently flexible stiffener panel is sealed to the longer sheet in the region beyond the shorter sheet and is covered by the third sheet. This multi-piece construction is complex and expensive to manufacture and it is inconvenient to manipulate the flap when inserting or removing the merchandise.

SUMMARY OF THE INVENTION

It is desired to provide a bag type container construction which is simple and economical to manufacture and which allows for easy insertion and removal of merchandise. At the same time it is desired that the container have a closure which effectively retains the merchandise during normal handling.

According to the present invention, there is provided a novel flexible bag type container construction which comprises a pair of rectangular flexible sheets of the same size which are sealed to each other around their periphery. One of the sheets is constructed or reinforced so as to be made stiff and resiliently bendable about an axis in a region near one end of the sheets. The other sheet is slit in a direction transverse to the axis of bending and the slit is located at a position entirely within the resiliently bendable region. By locating the slit entirely within the resiliently bendable region, the slit may be opened for the insertion or removal of merchandise by flexing the resiliently bendable region; and when the resiliently bendable region is thereafter released, it returns to a flat condition and causes the slit to close. The length of the slit is such that it does not extend to the edges of the other sheet, so that the other sheet is continuous around the slit. This feature makes the container stronger. It does not tear apart as other designs.

DETAILED DESCRIPTION OF THE PREFERRED EMBODIMENT

Figure 1:
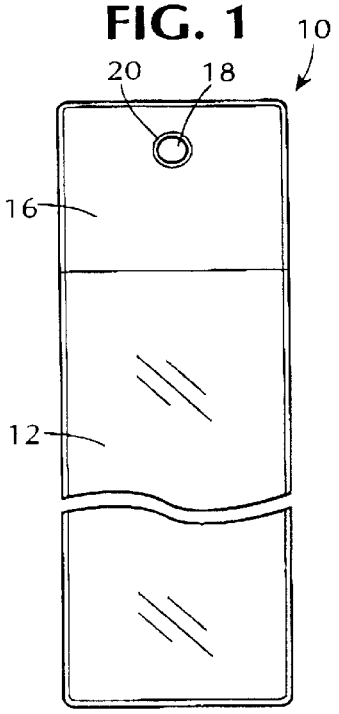
FIG. 1 is a front view of a bag type container embodying the present invention.
Figure 2:
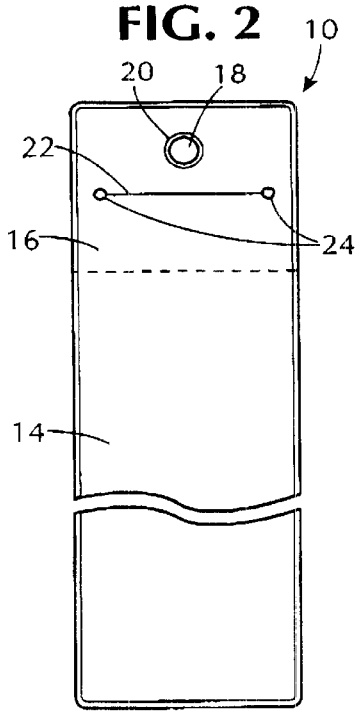
FIG. 2 is a rear view of the container of FIG. 1.

As shown in FIGS. 1 and 2, a bag type container 10 according to the present invention is of generally rectangular configuration. The dimensions of the container are not critical but, by way of example, the illustrated container may have a width of about two or three inches (5.08 cm or 7.62 cm) and a length of about 22 inches (55.88 cm). The container 10 may be shorter or longer; and it may be narrower or wider. The container is formed from a front rectangular panel 12 (FIG. 1) of flexible plastic material and a rear rectangular panel 14 (FIG. 2) which is also of flexible plastic material. The panels 12 and 14 are of the same size and are sealed around their entire periphery, for example by fusing or welding them together. The front panel 12 may be transparent in order to permit one to view merchandise within the container 10.

A relatively stiff resiliently bendable panel 16 is provided between the panels 12 and 14 at their upper ends and is sealed in place by the sealing together of the panels 12 and 14. A mounting hole 18 is formed at the upper end of the container 10 and extends through both the front and the rear panels 12 and 14 as well as through the resiliently bendable panel 16. The mounting hole 18 may be reinforced by fusing the material of the panels 12, 14 and 16 around its periphery or a grommet 20, for example of metal, may be provided to extend through the mounting hole. The mounting hole 18 need not be circular. It may, for example, be elongated in the width direction of the container and this elongated hole may be formed with either an upper or upper and lower semi-circular or "half moon" widening in the center thereof. Also, the mounting hole 18 may be in the form of a "J" hook slot that extends down from the top of the container near one side and horizontally to the center of the container and then upwardly a short distance.

It will be appreciated that instead of a separate panel 16, the front panel 12 may itself be made of a stiff, resiliently flexible material, at least in the region that can be occupied by the panel 16. Where a panel 16 is used to make the front panel stiff and resiliently bendable, it may be printed with product information which shows through the transparent front panel 12.

As shown in FIG. 2, the back panel 14 is provided with a slit 22 which extends from a location part way from one side of the container 10 to a location part way to the opposite side of the container. It will be noted that the slit 22 is located entirely within the region occupied by the resiliently bendable panel 16 so that the back panel 14 is continuous around the slit. Preferably, the slit 22 is located in the middle of the region occupied by the resiliently bendable panel 16. The slit 22 is terminated at each end thereof by means of small circular cutouts 24. These cutouts act as stress relievers and provide increased resistance to tearing as the slit is opened, as will be described hereinafter.

Figure 3:
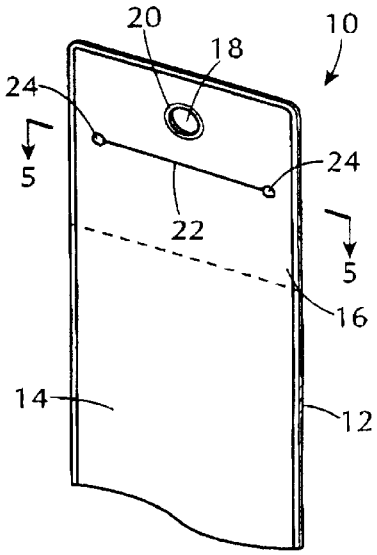
FIG. 3 is a perspective view showing the container of FIGS. 1 and 2 in a flat, closed, configuration.
Figure 5:
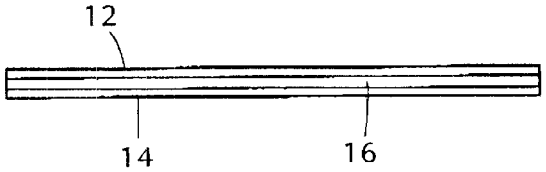
FIG. 5 is a section view taken along line 5—5 of FIG. 3.

FIG. 3 shows the container 10 in flat condition with the slit 22 in closed condition. This is the normal configuration of the container. As can be seen in the section view of FIG. 5, the slit 22 is closed with the rear panel 14 lying flat against the resiliently bendable panel 16.

Figure 4:
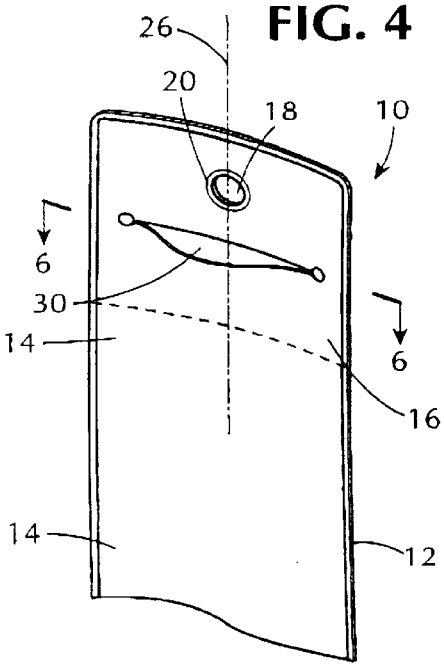
FIG. 4 is a perspective view similar to FIG. 3 but showing the container in a flexed, open, condition.
Figure 6:
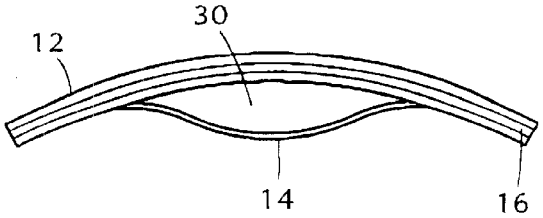
FIG. 6 is a section view taken along line 6—6 of FIG. 4.

When it is desired to open the container 10 for the insertion or removal of merchandise, the side edges of the container are squeezed together near its upper end, i.e. in the region of the resiliently bendable panel 16, so that the upper end of the container becomes bent about a vertical or longitudinal axis 26 as shown in FIG. 4. As can be seen, this bending axis is transverse to the direction in which the slit 22 extends. It will also be seen that bending is in a direction such that the panel 16 becomes concave in a direction facing the rear panel 14. This causes the portion of the rear panel 14 below the slit 22 to flex outwardly as shown at 28, while the portion of the rear panel 14 above the slit remains against the resiliently bendable panel 16, thereby to form an opening 30 as shown in FIG. 6. It will be appreciated that the panels 12, 14 and 16 are secured to each other on one side of the slit 22, namely where the mounting hole 18 is formed. This holds the region of the rear panel 14 above the slit in a concave configuration while the region below the slit flexes out to form the opening 30.

In order to close the container, the sides of the container are released and the resilient panel 16 reverts to a flattened condition. This brings the region of the rear panel 14 below the slit 22 back against the resiliently bendable panel 16, thereby closing the slit 22.

It will be noted that the slit 22 is located entirely within the region of the resiliently flexible panel 16. This enables the panel 16 to maintain the slit 22 in a closed configuration when the panel reverts to an unstressed flat configuration. It should also be noted that the ends of the slit 22 terminate short of the sides of the panel 14. As a result, the panel 14 extends continuously along the flexible panel 16 in side regions beyond the ends of the slit 22. This enables the portion of the panel 14 which lies above the slit to pull the portion which lies below the slit back to a closed condition when the resilient panel 16 reverts to its flat configuration.

It will be appreciated that a container according to this invention is inexpensive and simple to construct in that it merely requires a front panel, a rear panel and a resiliently flexible panel which are welded together around their outer periphery; and a slit formed in the rear panel within the region occupied by the resiliently flexible panel. Also this invention takes advantage of the resiliently flexible panel's ability to return the opening formed by the slit to a closed condition and the continuous integral region of the rear panel around the ends of the slit to maintain the slit in a closed condition.

What is claimed is:

1. A flexible self closing container comprising two flat, rectangular, equal size panels of flexible sheet material sealed to each other around their outer periphery, one of said panels being made stiff and resiliently bendable about an axis at least in a region near one end thereof and the other panel having a slit extending along a line transverse to said axis and located within said region, said slit terminating short of the sides of said container, said one panel being stiffer and more resiliently bendable in said region than said other panel such that when the side edges of the container are squeezed together near said one end, the one panel is bent in a concave direction facing the other panel and causes a portion of the other panel on one side of the slit to flex outwardly, thereby to cause the slit to form an opening into the container, and when the sides of the container are released, the resilient panel reverts to a flattened condition to bring the region of the one panel on said one side of said slit back against the resiliently bendable panel, thereby to close said slit, the stiffened, resiliently bendable panel tending to hold the container flat in order to return the panel having the slit to a flattened condition in which the slit is held closed after it has been opened to insert or remove items into or out of said container.

2. A container according to claim 1, wherein the one panel is a front panel and the other panel having a slit is a back panel.

3. A container according to claim 1, wherein said panels are secured to each other in said region above said slit.

4. A container according to claim 3, wherein a mounting hole is formed in said panels where said panels are secured to each other in said region.

5. A container according to claim 4, wherein a grommet extends through said mounting hole.

6. A container according to claim 1, wherein said panels are long and narrow and said region is at one end of said long panels.

7. A container according to claim 6, wherein said region extends across the width of said panels.

8. A container according to claim 7, wherein said slit extends in a direction across said width.

9. A container according to claim 1, wherein stress relief holes are provided in said other panel at each end of said slit to increase resistance to tearing.

10. A container according to claim 2, wherein said front panel is transparent.

11. A flexible self closing container comprising two flat, rectangular, equal size panels of flexible sheet material sealed to each other around their outer periphery, one of said panels being made stiff and resiliently bendable about an axis, at least in a region near one end thereof and the other panel having a slit extending along a line transverse to said axis and located within said region, said slit terminating short of the sides of said container, the stiffness of the resiliently bendable panel being sufficient to hold the other panel flat so as to return the other panel to a flattened condition in which the slit is held closed after it has been opened to insert or remove items into or out of said container, so that when the side edges of the container are squeezed together near said one end, the one panel is bent in a concave direction facing the other panel and causes a portion of the other panel on one side of the slit to flex outwardly, thereby to cause the slit to form an opening into the container, and when the sides of the container are released, the resilient panel reverts to a flattened condition to bring the region of the one panel on said one side of said slit back against the resiliently bendable panel, thereby to close said slit, wherein the one panel is made stiff and resiliently bendable by means of a further panel interposed between said two panels and which extends over said region.

12. A container according to claim 11, wherein said panels are secured to each other in said region above said slit.

13. A container according to claim 12, wherein a mounting hole is formed in said panels where said panels are secured to each other in said region.

14. A container according to claim 13, wherein a grommet extends through said mounting hole.

* * * * *